US006486849B2

(12) United States Patent
Buckles

(10) Patent No.: US 6,486,849 B2
(45) Date of Patent: Nov. 26, 2002

(54) SMALL L-BAND ANTENNA

(75) Inventor: Rondald L. Buckles, Fullerton, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/783,662

(22) Filed: Feb. 14, 2001

(65) Prior Publication Data

US 2002/0109643 A1 Aug. 15, 2002

(51) Int. Cl.[7] ..... H01Q 9/28

(52) U.S. Cl. ..... 343/808; 343/773; 343/807; 343/896

(58) Field of Search ..... 343/773, 806, 343/807, 808, 846, 896; H01Q 9/28

(56) References Cited

U.S. PATENT DOCUMENTS 2,599,896 A * 6/1952 Clark et al. ..... 343/754
4,074,268 A * 2/1978 Olson ..... 343/773
5,260,820 A * 11/1993 Bull et al. ..... 359/145
5,923,299 A * 7/1999 Brown et al. ..... 343/773
6,154,182 A * 11/2000 McLean ..... 343/773
6,198,454 B1 * 3/2001 Sharp et al. ..... 343/773

OTHER PUBLICATIONS

Mingyu and Changsheng, A High–quality Ultra–wideband Omni–Direction Antenna, 1997 International Symposium on Electromagnetics Compatibility Proceedings, 1997, pp. 122–125 (Tsinghua University, Beijing, China).

* cited by examiner

*Primary Examiner*—Tho Phan
(74) *Attorney, Agent, or Firm*—Leonard A. Alkov; Glenn H. Lenzen, Jr.

(57) ABSTRACT

A compact L-band antenna includes a plurality of elongated radiating elements arranged in a conical configuration. Ends of the radiating elements are attached to provide a single conductor end, which is attached to a connector structure.

21 Claims, 2 Drawing Sheets

SMALL L-BAND ANTENNA

This invention was made with Government support under Contract No. N00019-98-C-0003 awarded by the Department of the Navy. The Government has certain rights in this invention.

TECHNICAL FIELD OF THE INVENTION

This invention relates to RF antennas, and more particularly to L-band antennas.

BACKGROUND OF THE INVENTION

Log-periodic antennas have been used for L-band applications, but are generally relatively large. Dipole stub antennas have also been used for certain L-band frequencies, but provide unsatisfactory performance at higher frequencies in the L-band range from 500 MHz to 2 GHz.

Bi-conical antennas have been employed for low frequency applications below L-band It would therefore be advantageous to provide an L-band antenna which is relatively small and has good wide-band performance.

SUMMARY OF THE INVENTION

An L-band antenna is described, and includes a plurality of elongated radiating elements arranged in a conical configuration, the radiating elements having first and second ends, the first ends of the elements attached in a tapered fashion to provide a conductive tapered end. The tapered end is attached to a connector.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
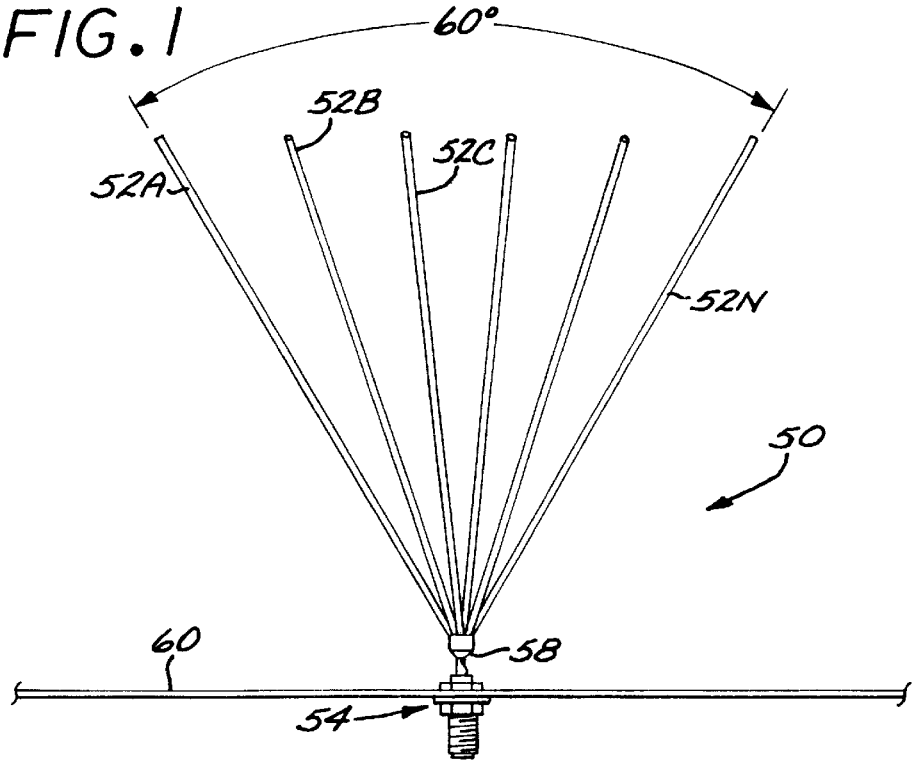
FIG. 1 is a side view of an L-band antenna embodying this invention.
Figure 2:
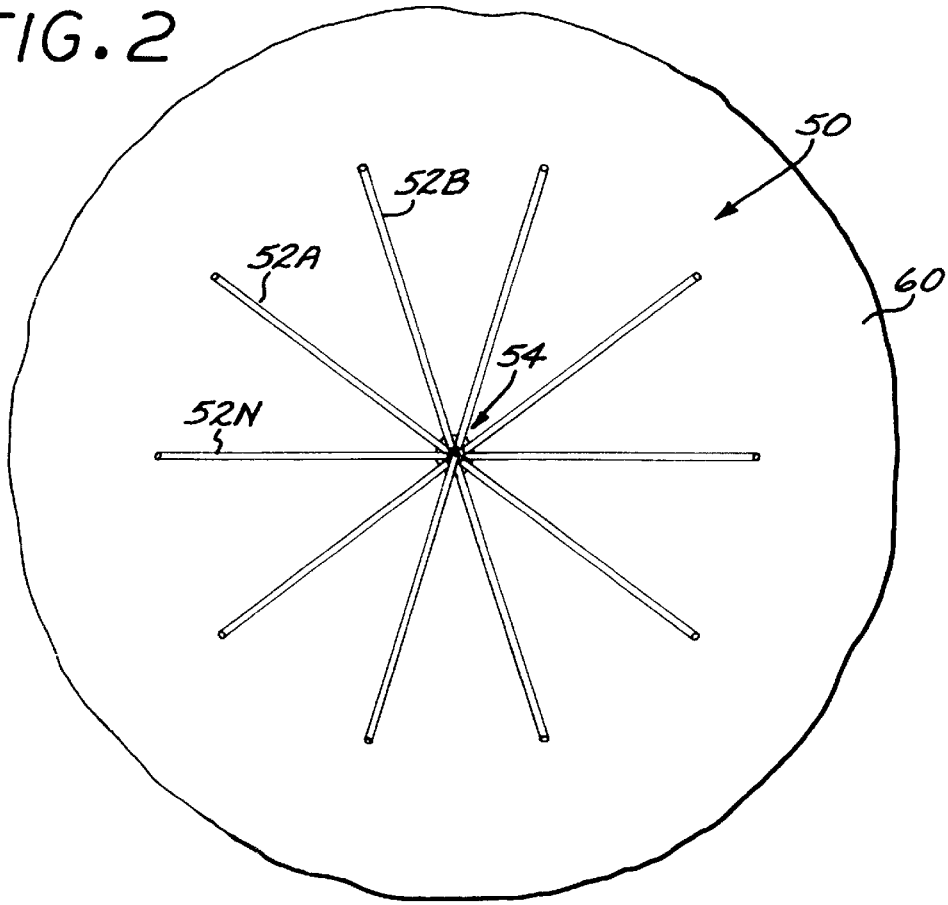
FIG. 2 is a top view of the antenna of FIG. 1.

An exemplary embodiment of an L-band antenna 50 in accordance with aspects of this invention is illustrated in FIGS. 1 and 2. The antenna includes in this exemplary embodiment ten elements 52A–52N, which in this exemplary embodiment are bus wires fabricated from # 20 American Wire Gauge (AWG). In this exemplary embodiment, the antenna is attached to an SMA rear mount bulkhead connector 54, although other structures could alternatively be employed to mount the antenna and electrically connect the antenna to a transmitter or receiver.

The elements 52A–52N are equally spaced and form a cone that is 60 degrees wide. In this exemplary embodiment, the connector 54 is secured through an opening in a ground plane structure 60, which can be a metal plate having an extent at least 2–3 times as large as the diameter subtended by the distal ends of the elements 52A–52N. The ground plane acts as a mirror for the antenna, and so the larger the ground plane the better the performance.

The length of the wires 52A–52N that form the cone is three inches in this exemplary embodiment. The elements are soldered together at the tip of the cone, with one wire, here 52C having an end protruding from the tip of the cone to provide a center conductor to which an electrical connection can be made. In this embodiment, the transition 58 from the ten soldered wires to one central wire for the bulkhead connector is tapered at a taper angle in the range of 45° to 60°. This tapering improves the electrical performance, in that the antenna reflects less energy and is more efficient.

Figure 3:
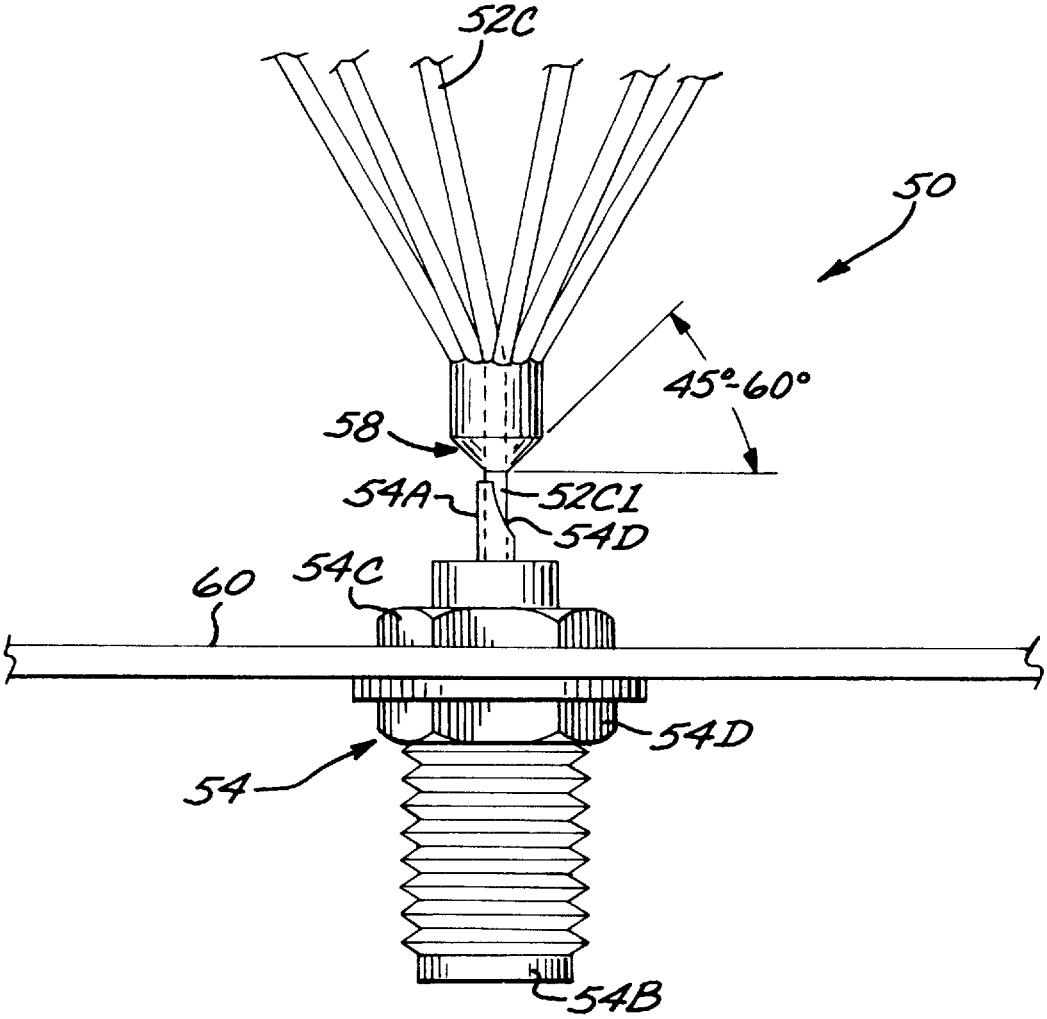
FIG. 3 is an enlargement of a portion of the side view of FIG. 1.

An exemplary form of the connector 54 is illustrated in the enlarged side view of FIG. 3. The connector includes a center conductor 54A and a cylindrical outer conductor 54B with an external threaded surface. The ground plane structure 60 is captured between the shoulder 54C and the threaded nut 54D and washer 54E to secure the connector and the antenna to the ground plane structure.

In an exemplary embodiment, the connector 54 includes a center conductor 54A with a solder cup 54D at its distal end. The solder cup is hollowed out at a diameter just large enough to receive therein the tip 52C1 of one of the wire elements 52A–52N, here shown as element 52C, which is then soldered in place. Thus, the center conductor 54A has a diameter only slightly larger than the diameter of the wire element 52C. A standard SMA connector has a center conductor diameter of 0.050 inch, which is about equal to the diameter of # 20 AWG wire.

The antenna can be mechanically supported by packing dielectric material, preferably with a relative dielectric constant equal to that of air, about the base of the antenna at the connector. Alternatively, a dielectric potting compound could be employed, if required for a particular application.

The number of wires 52A–52N can be varied depending on the application. In general, the more elements, the better the antenna performance. To reduce the cost, and maintain temperature stability, simple bus wire, i.e. wire without insulation, can be employed as the material for the antenna elements. For this exemplary embodiment, the maximum number of wires that could be grouped into a manageable bundle is ten, but for other applications, a larger or small number could be employed.

For best performance, the conical angle for a particular application was determined to be 60°. Angles below 50° had reduced performance, and angles above 70° made the antenna larger than desired for a particular application.

The length of the antenna elements is an important parameter. The cutoff frequency of the antenna is directly related to the element length, in an inverse relationship, so that the longer the elements, the lower the cutoff frequency. With elements of length 3 inches, this exemplary embodiment of the antenna does not work below 450 MHz.

The connector 54 provides a connection for a coaxial cable running to an RF transmit source or receiver. The antenna 50 provides an omnidirectional azimuth pattern.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An L-band antenna, including a plurality of elongated slender radiating elements arranged in a conical configuration, the radiating elements having first and second ends, the first ends of the elements attached in a tapered fashion to provide a conductive tapered end, and a center conductor protruding from the conductive tapered end for connecting the antenna to a transmit source or receiver.

2. The antenna of claim 1 wherein the elements are equally spaced and form a cone angle that is in the range of 45° to 70° degrees.

3. The antenna of claim 1 wherein the elements form a cone angle of nominally 60°.

4. The antenna of claim 1 wherein said radiating elements have a nominal length of three inches.

5. The antenna of claim 1 wherein the elements are soldered together at the tip of the cone.

6. The antenna of claim 1 wherein the conductive tapered end is tapered at a taper angle in the range of 45° to 60°.

7. The antenna of claim 1 wherein the elements are wires having a length selected to provide an antenna cutoff frequency between 450 MHz and 500 MHz.

8. The antenna of claim 1 wherein the elements are wires having a length selected to provide an antenna cutoff frequency of about 450 MHz.

9. The antenna of claim 1 further including a ground plane structure, the conical configuration has a center axis disposed in a direction transverse to the ground plane structure.

10. The antenna of claim 1 wherein said plurality of radiating elements consists of ten elements.

11. The antenna of claim 1 further comprising a connector structure having a center conductor, wherein the tapered end is electrically connected to the center conductor of the connector.

12. The antenna of claim 11 wherein the connector structure comprises a coaxial connector.

13. An L-band antenna, comprising:

a plurality of thin wire radiating elements arranged in a conical configuration, the radiating elements having first and second ends, the first ends of the elements attached in a tapered fashion to provide a conductive tapered end;

a connector structure having a center conductor, wherein the conductive tapered end is electrically connected to the center conductor of the connector; and a ground plane structure, said connector structure secured to said ground plane structure to hold said plurality of radiating elements in a fixed relation.

14. The antenna of claim 13 wherein the conical configuration has a center axis, and the connector structure holds the plurality of radiating elements such that the center axis is transverse to the ground plane structure.

15. The antenna of claim 13 wherein the elements are equally spaced and form a cone angle that is in the range of 45° to 70° degrees.

16. The antenna of claim 13 wherein the elements form a cone angle of nominally 60°.

17. The antenna of claim 13 where in said wires have a length of three inches.

18. The antenna of claim 13 wherein the elements are soldered together at the tip of the cone, each wire has a nominal cross-sectional dimension equal to the cross-sectional dimension of the connector structure center conductor, and a first end of one of said elements protrudes from said tapered end and is joined to an end of the center conductor.

19. The antenna of claim 13 wherein the connector is a coaxial connector structure.

20. The antenna of claim 13 wherein the elements are wires having a length selected to provide an antenna cutoff frequency between 450 MHz and 500 MHz.

21. The antenna of claim 13 wherein the elements are wires having a length selected to provide an antenna cutoff frequency of about 450 MHz.

* * * * *